US006520218B1

(12) United States Patent
Gregg et al.

(10) Patent No.: US 6,520,218 B1
(45) Date of Patent: Feb. 18, 2003

(54) CONTAINER CHEMICAL GUARD

(75) Inventors: John N. Gregg, Marble Falls, TX (US); Gregory W. Harris, Marble Falls, TX (US); Frank L. Cook, Buchanan Dam, TX (US); Robert M. Jackson, Burnet, TX (US)

(73) Assignee: Advanced Technology Materials, Inc., Danbury, CT (US)

( * ) Notice: Subject to any disclaimer, the term of this patent is extended or adjusted under 35 U.S.C. 154(b) by 0 days.

(21) Appl. No.: 09/146,407

(22) Filed: Sep. 3, 1998

(51) Int. Cl.[7] ..... F17C 13/00

(52) U.S. Cl. ..... 141/4; 141/1; 141/7; 141/8; 141/18; 141/44; 141/48; 141/63; 141/64; 141/65; 141/66

(58) Field of Search ..... 141/1, 2, 4, 5, 141/7, 8, 18, 21, 44, 47, 48, 54, 59, 63–66, 86; 222/108, 109

(56) References Cited

U.S. PATENT DOCUMENTS

| | | | | | |
|---|---|---|---|---|---|
| 4,859,375 | A | * | 8/1989 | Lipisko et al. | 141/1 |
| 5,383,499 | A | * | 1/1995 | Mattern | 141/65 |
| 5,465,766 | A | | 11/1995 | Siegele et al. | 141/198 |
| 5,562,132 | A | | 10/1996 | Siegele et al. | 141/198 |
| 5,590,695 | A | | 1/1997 | Siegele et al. | 141/121 |
| 5,607,002 | A | | 3/1997 | Siegele et al. | 141/198 |
| 5,711,354 | A | | 1/1998 | Siegele et al. | 141/198 |
| 6,079,459 | A | * | 6/2000 | Klotz et al. | 141/65 |
| 6,079,461 | A | * | 6/2000 | Fisher et al. | 141/1 |
| 6,080,679 | A | * | 6/2000 | Suzuki | 141/65 |
| 6,082,414 | A | * | 7/2000 | Wu et al. | 141/8 |

* cited by examiner

*Primary Examiner*—J. Casimer Jacyna
(74) *Attorney, Agent, or Firm*—Margaret Chappuis; William Ryann

(57) ABSTRACT

In a first respect this invention is a container, comprising: a cylindrical, hollow body capped on both ends by a base and a top; a conduit that bisects the top and extends into the interior of the container; and a perforated housing that encompasses the portion of the conduit that extends into the interior of the container. In another broad respect, this invention is a removable splash guard, comprising: a housing having a top and bottom that define an internal space; a lower tube that bisects the bottom, wherein the lower tube has a upper portion which is angled; an upper tube that bisects the top, wherein a portion of the second tube that extends into the internal space contains at least one hole; and a partition interposed between the upper and lower tubes that serves to block movement of a chemical from the lower tube to the opening at the inboard end of the upper tube. In another respect, this invention incorporates a flow restrictor of any type or material into the inlet or outlet tubing to reduce the pressurization or de-pressurization steps in a line drain sequence.

12 Claims, 5 Drawing Sheets

CONTAINER CHEMICAL GUARD

BACKGROUND OF INVENTION

This invention relates to inlet guards for containers for canisters holding a chemical such as tetraethylorthosilicate (TEOS).

The chemicals used in the fabrication of integrated circuits must have a ultrahigh purity to allow satisfactory process yields. As integrated circuits have decreased in size, there has been a directly proportional increase in the need for maintaining the purity of source chemicals. This is because contaminants are more likely to deleteriously affect the electrical properties of integrated circuits as line spacing and interlayer dielectric thicknesses decrease.

High purity chemicals have been fed to the integrated circuit fabrication process from a variety of volume containers. Representative examples of such containers are described in U.S. Pat. Nos. 5,465,766; 5,562,132; 5,590,695; 5,607,002; and 5,711,354.

High purity chemical container delivery and change out sequences consist of several steps. Each step is important to achieve the required level of removal of liquid vapor and trace moisture. One such step is the liquid drain sequence. During this sequence the canister may be rapidly depressurized through the inlet valve, for instance, and re-pressurized through the outlet weldment and outlet valve. These line drain sequences, which are commonly carried out in chemical delivery systems for chemicals such as TEOS, may result in splashing and/or spraying of the chemical throughout the interior of the canister. The residual liquids in and around the inlet valve become entrained in the flow of gas during the rapid depressurization step. Each line drain moves more liquid further into the inlet or dry side weldment. For standard materials, and even more so for new materials, multiple line drains are required to adequately remove all liquid from wetted surfaces of valves and tubing.

For standard CVD materials, such as TEOS, TEB, or TEPO, this is typically not a major concern. However, for low vapor pressure and more viscous materials, removal of the liquid in the inlet become increasingly more difficult and more important. These materials are also more reactive and sometimes toxic. These materials must be removed completely for a successful canister change procedure. A solution to this problem, accordingly, would be highly desirable.

SUMMARY OF INVENTION

The present invention provides a solution to one or more of the problems and/or disadvantages discussed above.

In a first respect this invention is a container, comprising: a cylindrical, hollow body capped on both ends by a base and a top; a conduit that intersects the top and extends into the interior of the container; and a perforated housing that encompasses the portion of the conduit that extends into the interior of the container. In certain embodiments, the conduit may pass through the lid such that the conduit extends through the lid. Likewise, the housing may optionally be integral with the lid. The container may be configured so that the conduit extends out from the top away from the interior of the canister, and wherein a coupler is attached to the conduit above the top. The container may include a level sensor attached to the top that extends into the interior of the canister. The housing may include drainage holes on the lower portion of the housing. The container, conduit, and housing may be made of stainless steel. The container may further comprise an inlet valve that is attached to the conduit. The container may include a portion through which the conduit intersects and transverses the top of a cap seated on the canister for the level sensor. The container may include a digital, float level sensor attached to the top that extends into the interior of the canister. The tip of conduit may extend into the canister and a base of the housing are each at an angle relative to the top of the canister. The conduit may be fitted with a gasket or particle filter to restrict flow through the conduit.

In another broad respect, this invention is a removable splash guard, comprising: a housing having a top and bottom that define an internal space; a lower tube that bisects the bottom, wherein the lower tube has an upper portion which is angled; an upper tube that bisects the top, wherein a portion of the second tube that extends into the internal space contains at least one hole; and a partition interposed between the upper and lower tubes that serves to block movement of a chemical from the lower tube to the opening at the inboard end of the upper tube.

In another broad aspect, this invention is a method for depressurizing a canister that contains a chemical, comprising: attaching a splash guard to a line that runs to the canister; attaching a second line that connects the splash guard to a vacuum source; subjecting the canister to a vacuum; depressurizing the canister by introducing a gas into the canister; wherein the splash guard comprises: a housing having a top and bottom that define an internal space; a lower tube that bisects the bottom, wherein the tube has an upper portion which is angled; an upper tube that bisects the top, wherein a portion of the upper tube that extends into the internal space contains at least one hole; and a partition interposed between the upper and lower tubes that serves to block movement of a chemical from the lower tube to the opening at the inboard end of the upper tube.

In yet another broad respect, this invention is a method for the production of an integrated chip, comprising: providing a chemical to a process tool that employs the chemical in the manufacture of the integrated circuit, wherein the chemical is provided by a canister that is connected to a splash guard comprising: a housing having a top and bottom that define an internal space; a lower tube that bisects the bottom, wherein the lower tube has a upper portion which is angled; an upper tube that bisects the top, wherein a portion of the upper tube that extends into the internal space contains at least one hole; and a partition interposed between the upper and lower tubes that serves to block movement of a chemical from the lower tube to the opening at the inboard end of the upper tube.

DETAILED DESCRIPTION OF INVENTION

Figure 1:
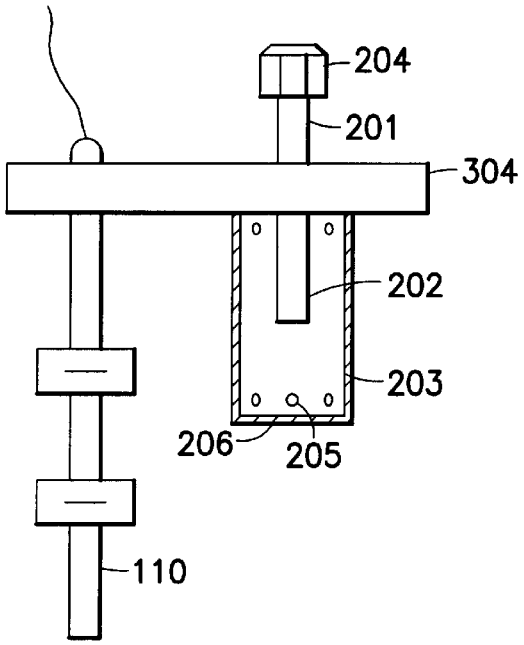
FIG. 1 shows a cross-sectional view of one embodiment of the chemical splash guard of this invention.
Figure 1A:
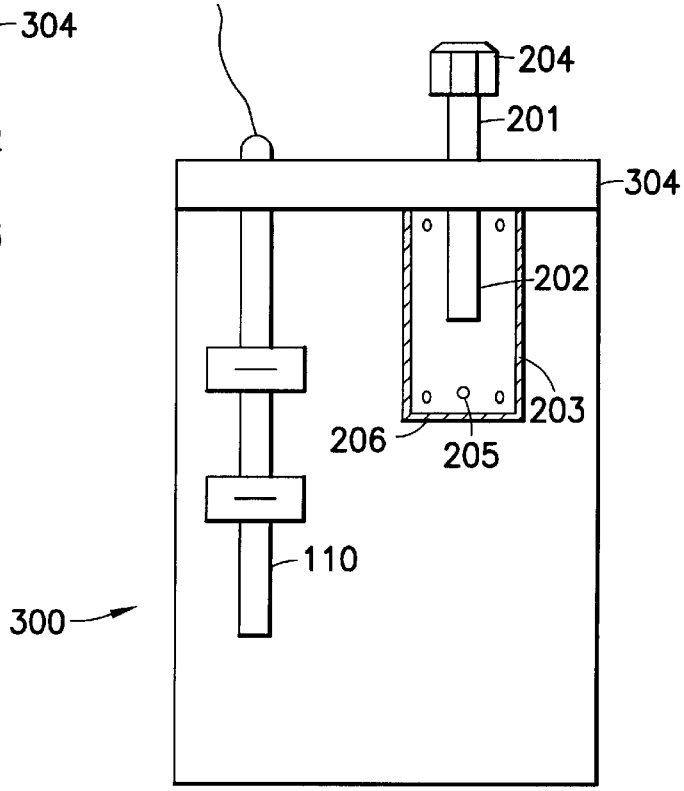
FIG. 1*a* shows a cross-sectional view of the embodiment of the chemical splash guard of FIG. 1 installed on a canister for storage and delivery of chemicals.

FIG. 1 shows one embodiment of the present invention. In FIG. 1, there is shown a level sensor 110 such as a metallic float sensor that extends through top 304. The top 304 may be part of a canister. For instance, FIG. 1*a* shows a configuration where top 304 forms the lid for canister 300. Representative canisters are depicted in U.S. Pat. Nos. 5,465,766; 5,562,132; 5,590,695; 5,607,002; and 5,711,354, incorporated herein by reference.

Figure 1B:
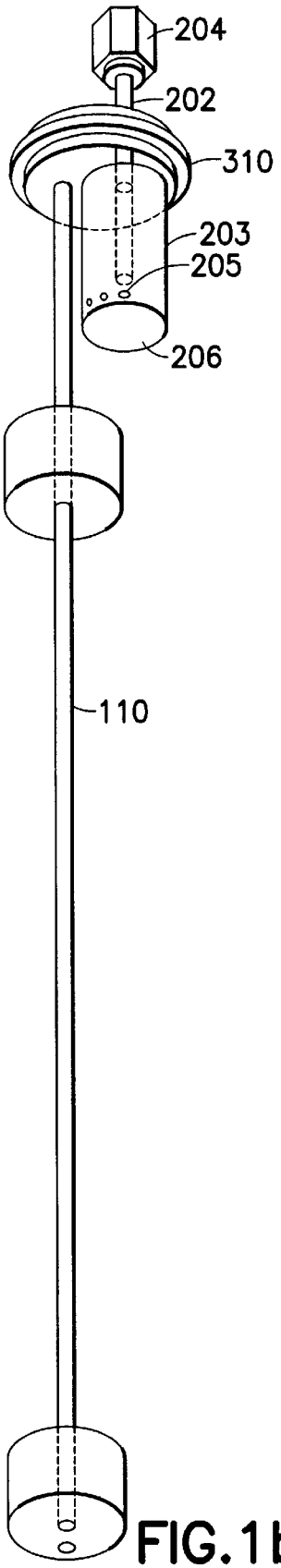
FIG. 1*b* shows a three dimensional, perspective view of the embodiment of the chemical splash guard of FIG. 1 installed on a canister for storage and delivery of chemicals.

In FIGS. 1, 1*a*, and 1*b* a housing 203 serves to form splash guard for protecting the inlet conduit 202, which may also be referred to herein as a tube, so that if chemicals in the canister splash due to a rapid re-pressurization, for example, of the canister then chemicals will not be entrained during the next depressurization step such that the chemicals enter the upper portion 201 of the tube that extends upward from the canister and connects to fitting (coupler) 204. The housing 203 may be of any shape, such as in the shape of a cylinder, dome, three-sided or four-sided rectangular prism, pyramid, cube, or any other enclosed shape. For the cylindrical housing depicted in FIGS. 1, 1*a*, and 1*b*, the housing is enclosed by top 304 of the canister 300 and by bottom 206. The top can also be separate from the canister lid. The bottom and/or housing may include holes 205 that serve to allow gas to flow in an out of the canister through the tube 202. Depending on location, the holes 205 may also serve to allow drainage of chemical from housing 203. The upper portion 201 of tube 202 may be attached to a coupler which serves as a fitting to connect the canister to another line or a canister isolation valve.

The canister depicted in FIG. 1*a* may also include outlet tubes (not shown) for dispensing chemical to a process tool. The outlet may be a piece of tubing that extends down into the canister any distance, and typically extends to the very bottom of the canister to facilitate removal of liquid chemical. While the canister, tubes, couplers, splash guard, and so forth may be made of any rigid material suitable for use with the chemical to be stored in the canister, stainless steel is typically used for chemicals employed in the manufacture of integrated circuits. The insides of stainless steel canisters may be electropolished. The canisters may also be lined, as with a Teflon™ liner or bag and the splash made of solid Teflon™ material or non-metal material. In this case, valves, fittings, and tubing could be made of similar material.

Canisters for delivery of high purity chemicals frequently have one or more openings into which are placed tubing or level sensors. The openings may be fitted with lids that serve to both seal the opening and provide support for the tubing or the like. In FIG. 1*b* there is shown the splash guard of this invention that has been attached to a lid that itself may be used to close an opening of a canister top. A tube 202 bisects the lid 310. A fitting/coupler 204 is connected to the portion of the tube 202 that extends above the lid 310. A level sensor 110 or an outlet (not depicted) may also be conveniently connected to the lid 310. In the embodiment of this invention depicted in FIG. 1*b*, the bottom 206 of the splash guard is flat, parallel to the lid, and circular in shape as viewed from below.

Figure 2:
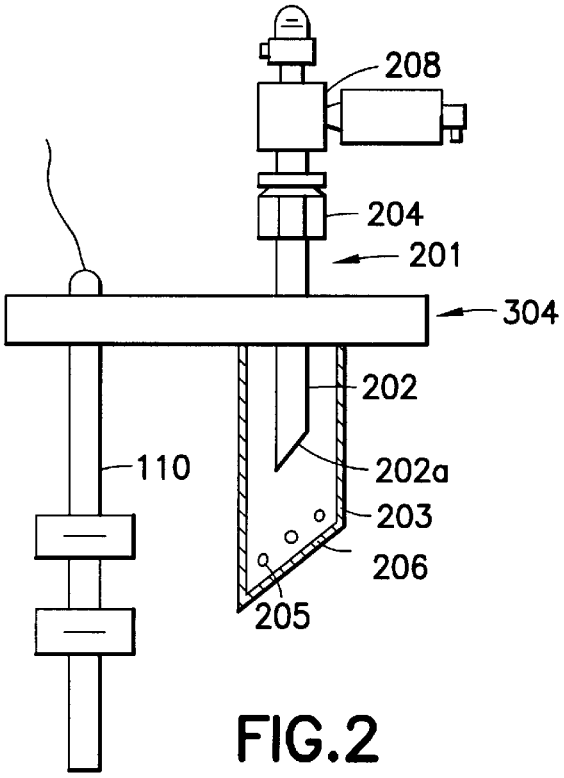
FIG. 2 shows a cross-sectional view of another embodiment of the chemical splash guard of this invention.

In FIG. 2 there is shown an alternative embodiment of the splash guard of this invention. In FIG. 2, the housing 203 is configured such that the base 206 of the housing and portion 202*a* of the tube 202 are set at an angle to facilitate drainage of chemical from these components of the splash guard. The coupler 204 has been connected to a line that includes valve 208 which can be a manual or pneumatic valve, for instance. The coupler may be any conventional fitting.

Figure 2A:
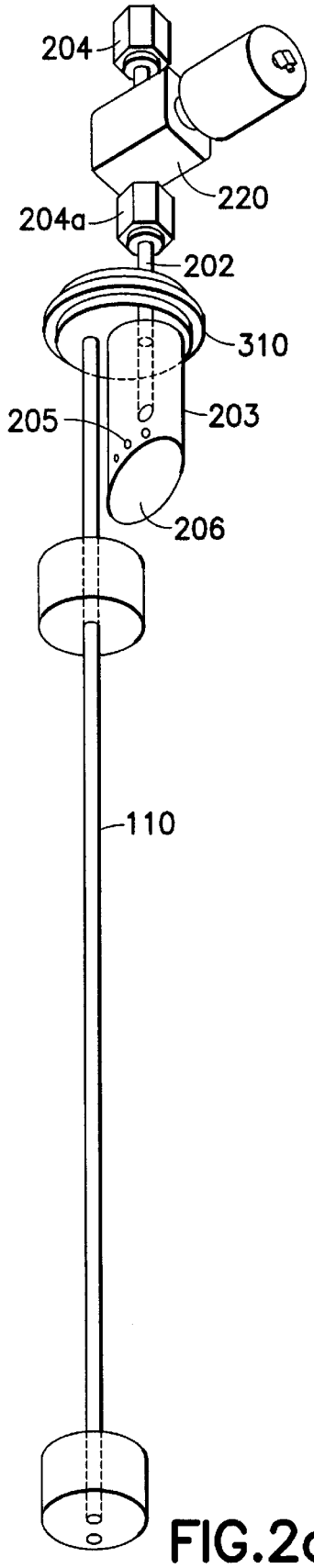
FIG. 2*a* shows a cross-sectional angled view of the chemical splash guard of FIG. 2.

The splash guard of FIG. 2 is depicted in FIG. 2*a* from an angled, three dimensional view. As can be seen, the bottom 206 is canted at an angle relative to the lid 310 through which the tube 202 extends. Tubing (not shown) may be connected to valve 204*a*, which may lead to a manifold or the like. In FIG. 2*a*, a valve (such as a pneumatic valve) 220 is connected to the portion of the tube 202 that extends above the lid 310. A fitting 204 (such as a VCR fitting) is seated above the valve 220.

Figure 3:
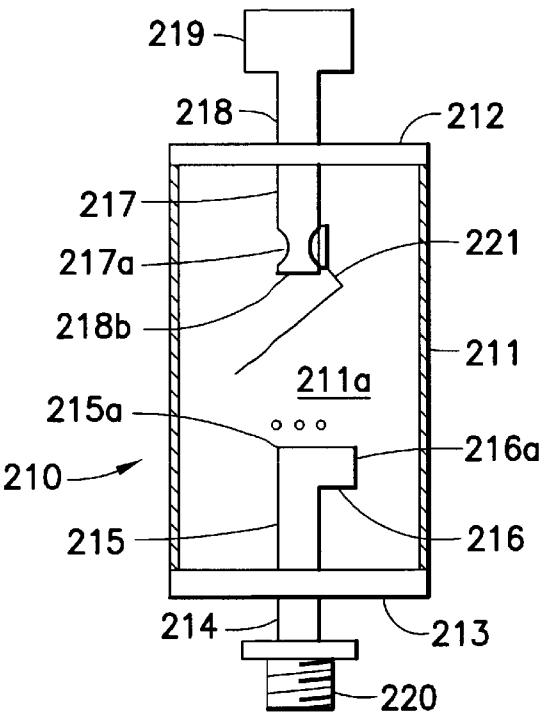
FIG. 3 shows a cross-sectional view of another embodiment of the chemical splash guard of this invention wherein the guard may be employed as a external component to be interposed in a line.

FIG. 3 illustrates an alternative embodiment for the splash guard of this invention. While the splash guards of FIGS. 1 and 2 were integral with the canister, the embodiment depicted in FIG. 3 illustrates a stand alone device that may be installed into an existing conduit, such as stainless steel tubing, that connects to a canister that provides for passage of chemical or gas to or from the canister.

Figure 4:
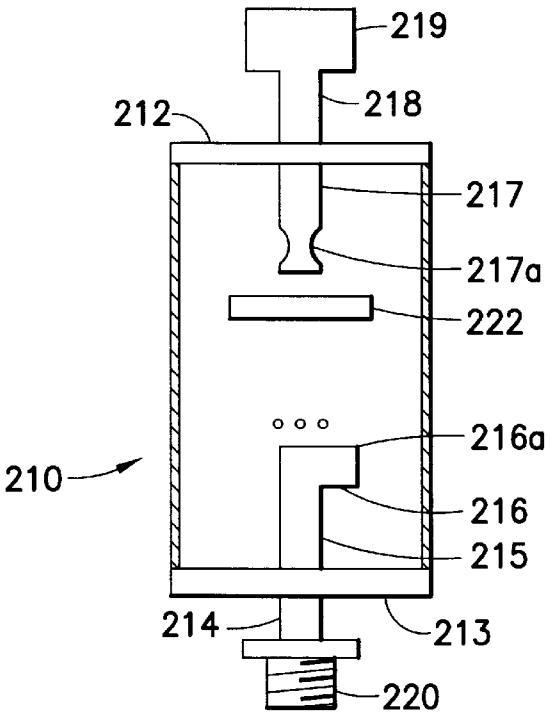
FIG. 4 shows a cross-sectional view of an alternative embodiment of the splash guard of this invention.

In FIG. 3, the housing 211 may be as described above and may include top 212 and bottom 213 that serve to define an enclosed space 211*a*. The housing can also be used inside the canister. First tube 218 and second tube 214 may be included. The tubes may be inserted though bores in the top 212 and bottom 213 of the guard 210. The tubes may be secured in place as by welding the tubes into place. In FIG. 3, the lower tube includes an inner (inboard) portion 215 that includes an angled bend 215*a* to form angled tube portion 216. In the embodiment shown in FIG. 3, the first and second tubes are affixed to female and male fittings 219 and 220. As an alternative to having an open end 218*b*, tube 217 may optionally include holes 217*a* to allow gas passage. The holes may serve to drain any chemical which became lodged in the tube. The embodiment in FIG. 3 also includes a surface 221 that serves to deflect chemical that may enter the inner space 211*a* from also entering tube 217. The surface may be of any shape or size which reduces the amount of chemical that might splatter upward from opening 216*a*. It may be appreciated that the lower portion of the guard may be configured to allow liquid that enters the guard to drain back into the line. Likewise, the lower tube may be flush with the bottom of the guard, thereby allowing any liquid that enters the guard to drain into the line. The bottom tube may also include an upwardly angled deflector. An alternative embodiment of the surface depicted in FIG. 3 is shown in FIG. 4. That is, whereas angled plate 221 is used in FIG. 3, a level disk 222, attached to walls of the housing 211, is used in FIG. 4 to serve to block migration of chemical up to second tube 217. The disk may be made of any material that will serve to block the chemical from moving upward. The disk may optionally completely fill the inner circumference of the housing and, if so, the disk should include holes or be porous so as to permit passage of gas through the guard. For instance, the disk may be a glass frit or may be made of a stainless steel sheet that includes holes.

Figure 3A:
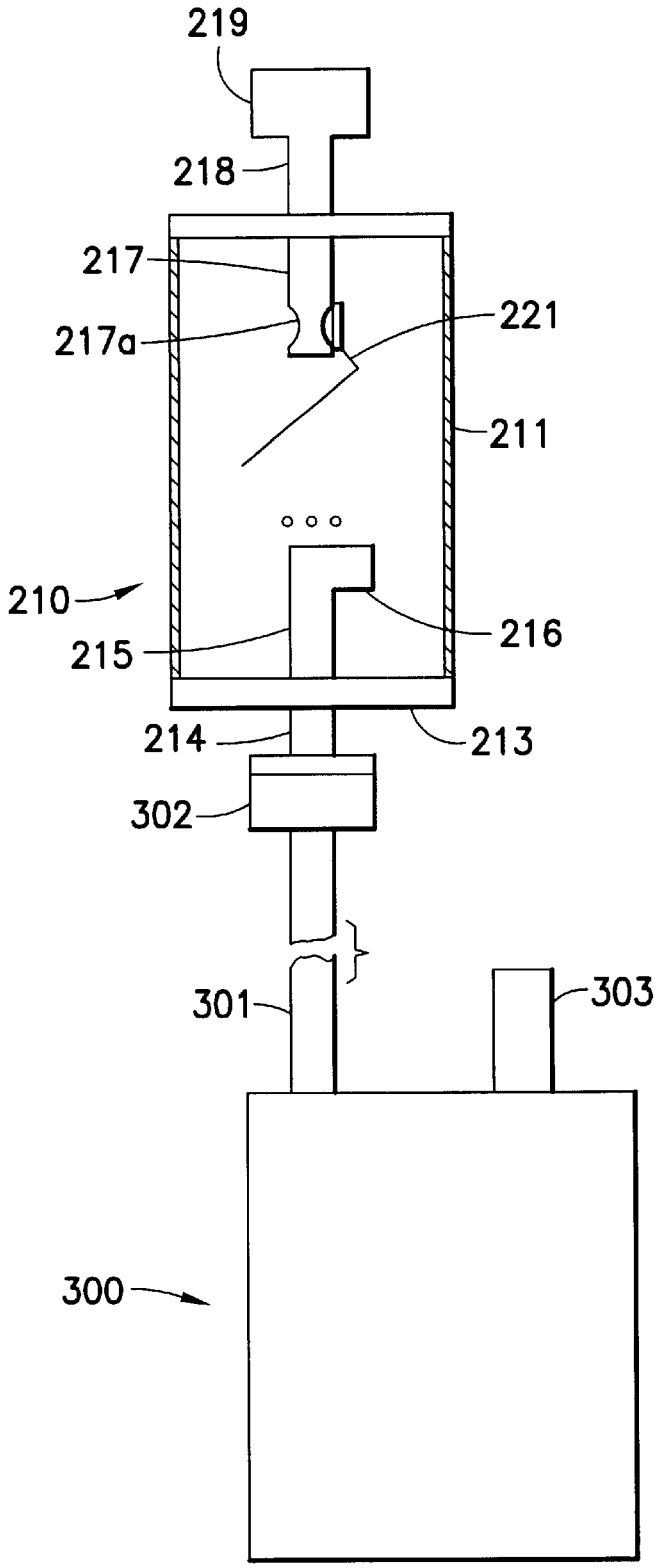
FIG. 3*a* shows a cross-sectional view of the chemical guard of FIG. 3 that is installed in a line above a canister.

FIG. 3*a* depicts the splash guard of FIG. 3 during use. In this regard, a line 301 is connected to the guard 210 by coupling of fittings 302 and 220. The outlet line 303 of canister 300 serves to provide chemical to a process tool, not shown. Canister isolation valves are not shown in this FIG. These valves would typically be attached at fitting 219 and line 303. As is described in U.S. Pat. Nos. 5,465,766; 5,562,132; 5,590,695; 5,607,002; and 5,711,354, during change out of a canister in a chemical delivery system, the canisters are subjected to a depressurization step as by providing positive pressure from an inert gas source to a canister through outlet line 303. This frequently causes chemical in the canister to erupt violently due to the significant change in pressure. The splash guard of this invention serves to limit the extent of chemical that splashes up into the inlet tube, which would otherwise deleteriously affect canister change out due to the presence of the chemical in the lines.

Figure 5:
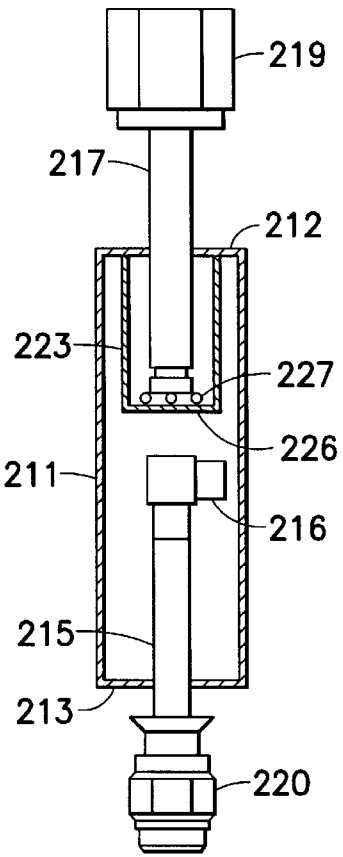
FIG. 5 shows a cross-sectional view of another alternative embodiment of the splash guard of this invention.

FIG. 5 shows another embodiment of this invention. Like the splash guard shown in FIG. 3, the embodiment of FIG. 5 illustrates a stand alone device that may be installed into an existing conduit. This embodiment may also be alternatively integral with the container. The embodiment of FIG. 5 differs somewhat from that of FIGS. 3 and 4 in that instead of using a level disk 222 or an angled plate 221, a housing 223 that includes holes 225 and a bottom 226 (similar to that employed in FIG. 1) is used to isolate the tube 217 that extends above and below top 212. The fittings 219 and 20 used in FIG. 5 are of the VCR type. As in all the embodiments of the splash guard, the embodiment shown in FIG. 5 may include a flow restrictor that is positioned in either tube 215 or 217.

The splash guard of this invention may be used in conjunction with a chemical delivery system such as described in the aforementioned patents. Thus, the splash guard may be used in a system that includes a refillable (or "bulk") canister that feeds chemical to a process canister through a manifold. The manifold serves to facilitate transfer of liquid chemical from the refill canister to the process canister and to enable the system to be purged of chemical so that one or more of the canisters may be changed or removed. The canisters and manifold may be housed in a cabinet. Chemical exiting the process canister may feed one or more process tools. In this regard, the process canister may be connected to a multiple branch manifold (such as a four branch manifold) through which chemical is distributed to the process tools or to other canisters, directly or indirectly. The particular system in which the splash guard is employed is not critical in the practice of this invention.

The types of chemicals which may be employed in the practice of this invention may vary widely depending on the type of process tool and desired outcome. Non-limiting examples of representative chemicals include tetraethylorthosilicate (TEOS), triethylphosphate, trimethyl phosphite, trimethyl borate, titanium tetrachloride, tantalum, titanium, and copper compounds, and the like; solvents such as chlorinated hydrocarbons, ketones such as acetone and methylethylketone, esters such as ethyl acetate, hydrocarbons, glycols, ethers, hexamethyldisilazane (HMDS), and the like; solid compounds dispersed in a liquid such as barium/strontium/titanate cocktails (mixtures). If the chemical being delivered is solid suspended in an organic liquid, the manifold may be designed so as to allow for liquid flush of all the lines, including the splash guard, to prevent solids accumulating in the lines upon evaporation of the organic liquid. If dispersions are employed, it is preferable to flush the lines out with liquid solvents such as triglyme or tetrahydrofuran (THF) so that compounds are not precipitated in the lines when the lines are depressurized. These examples of chemicals are not intended to be limiting in any way. The chemicals may be of a variety of purities, and mixtures of chemicals can be used. In one embodiment, a single type of chemical is employed. A given chemical may advantageously have a purity of 99.999% or more with respect to trace metals.

In addition, this invention may comprise use of a flow restrictor. The restrictor, which could be in the inlet weldment, for instance, could take the form of a VCR gasket with a critical orifice, a narrower tube diameter tube (for example, a ⅛ inch outside diameter stainless steel tube instead of ¼ inch), a valve that is designed with a critical orifice internal to the valve, a filter that functions as a flow restrictor, and a VCR gasket with an integral stainless steel frit. The flow restrictor may be used either in lieu of the splash guard or in combination therewith. Typically, if a flow restrictor is employed, it will be used by itself without use of the splash guard. Other variations could include reduced flow on the wet side weldment to reduce the flow during re-pressurization, which could be the same as mentioned in the immediately preceding sentence or a re-designed dip tube could be made to reduce splashing, or the canister could be modified to reduce splashing, and so forth.

Figure 6:
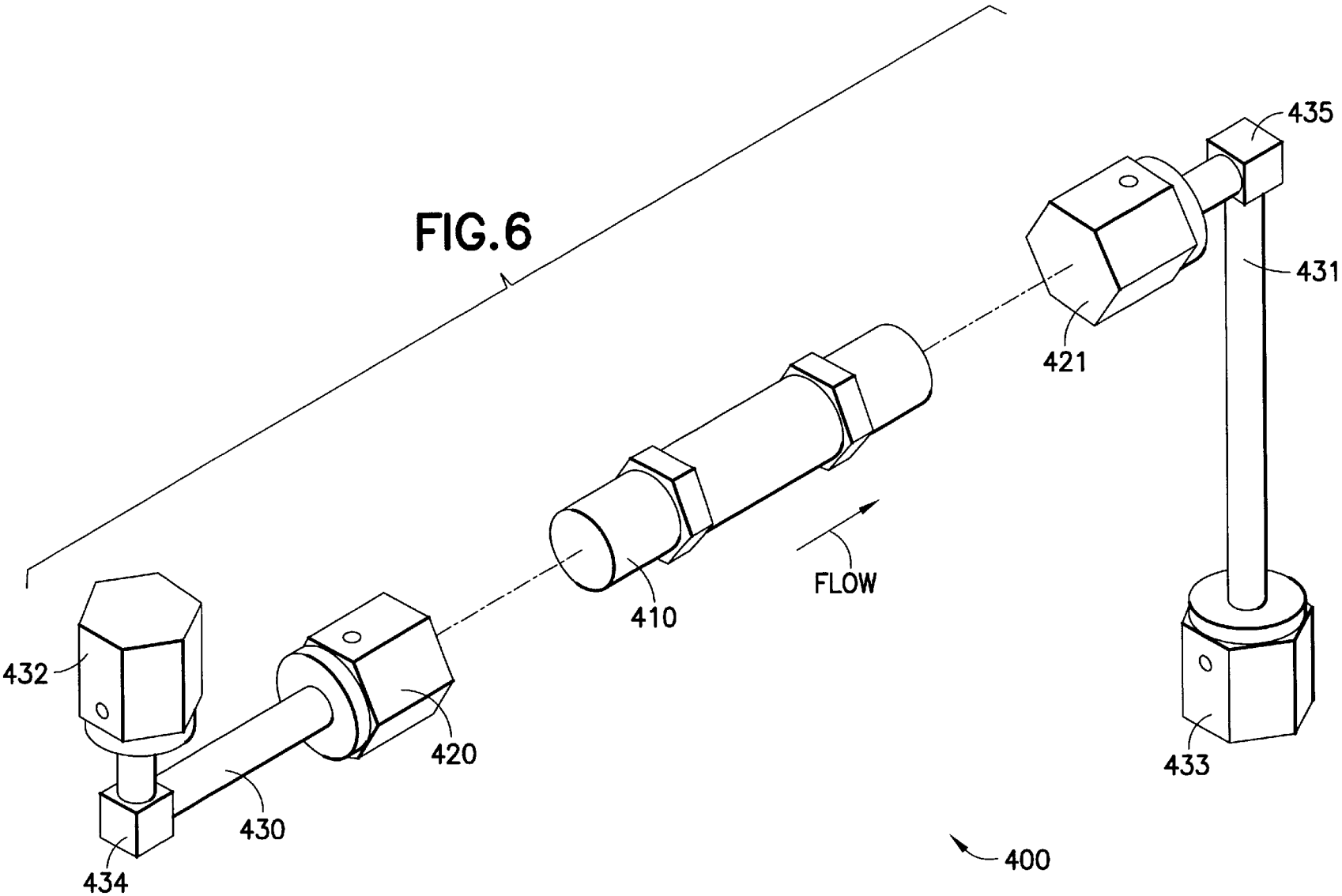
FIG. 6 shows a perspective, exploded view of an embodiment of the flow restrictor of this invention.

One representative flow restrictor is depicted in FIG. 6. This flow restrictor 400 is composed of several parts. This type of flow restrictor is designed to fasten to a conduit from a canister for high purity chemical delivery, such as described above. In FIG. 6, a particle filter 410 serves to reduce the flow of materials through the restrictor 400. The filter 410 is attached at opposite ends to fittings 420 and 421. The fittings 420 and 421 are attached to tubing 430 and 431 which themselves connect to additional fittings 432 and 433. The tubing in this case has bends 434 and 435. The flow restrictor may be attached directly in a line (i.e., a so-called "pigtail" or "weldment") from a canister to a manifold, line, or process tool. Typically, the flow restrictor is installed in a line from a canister to a manifold that dispenses the chemical. The flow restrictor may be made from metals or alloys such as stainless steel, such as 316 SS. It may also be made of Teflon™ materials or other non-metal substances.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as presently preferred embodiments. Equivalent elements may be substituted for those illustrated and described herein, and certain features of the invention may be utilized independently of the use of other features, all as would be apparent to one skilled in the art after having the benefit of this description of the invention.

What is claimed is:

1. A method for the depressurizing a canister that contains a chemical, comprising:

attaching a splash guard to a line that runs to the canister;

attaching a second line and valving that connects the splash guard to a vacuum source;

subjecting the canister to a vacuum as a depressurization step;

re-pressurizing the canister by introducing a gas into the canister through the outlet.

2. The method of claim 1 wherein the splash guard comprises a housing having a top and bottom that define an internal space;

a lower tube that bisects the bottom, wherein the tube has a upper portion which is angled;

a upper tube that bisects the top, wherein a portion of the upper tube that extends into the internal space contains at least one hole; and a partition interposed between the upper and lower tubes that serves to block movement of a chemical from the lower tube to the opening at the inboard end of the upper tube.

3. The method of claim 2 wherein the partition is an angled plate that is affixed to the upper tube.

4. The method of claim 2 wherein the upper portion is at approximately a right angle to the remainder of the lower tube.

5. The method of claim 2 wherein the lower tube is attached to a coupler outboard to the internal space.

6. The method of claim 2 wherein the upper tube is attached to a coupler outboard to the inner space.

7. The method of claim 2 wherein the upper tube includes one or more holes on the of the upper tube.

8. The method of claim 2 wherein the upper tube is closed on the inboard side.

9. The method of claim 2 further comprising a line that connects the upper tube to a canister containing a chemical.

10. The method of claim 2 further comprising a line that attaches to lower tube.

11. The method of claim 2 wherein the upper and lower tubes, the housing, and the partition are made of stainless steel.

12. The method of claim 2 wherein the upper tube is fitted with a gasket or particle filter to restrict flow through the upper tube.

* * * * *